US006764354B2

(12) United States Patent
Kaine et al.

(10) Patent No.: US 6,764,354 B2
(45) Date of Patent: Jul. 20, 2004

(54) SUBMERSIBLE ELECTRICAL SET-SCREW CONNECTOR

(76) Inventors: Michel Kaine, 100 Ave des Sommets, #203 Nun's Island Quebec (CA), H3E 1Z8; Jean Langelier, 1115 131 Street, St-George Quebec (CA), G5Y 2T2

( * ) Notice: Subject to any disclaimer, the term of this patent is extended or adjusted under 35 U.S.C. 154(b) by 0 days.

(21) Appl. No.: 10/331,419

(22) Filed: Dec. 30, 2002

(65) Prior Publication Data

US 2003/0124915 A1 Jul. 3, 2003

(30) Foreign Application Priority Data

Dec. 31, 2001 (GB) ..... 0131070

(51) Int. Cl.[7] ..... H01R 11/03

(52) U.S. Cl. ..... 439/793; 439/798; 439/810; 439/892; 439/606; D13/151

(58) Field of Search ..... 439/793, 794, 439/796–798, 810, 812–814, 587, 271, 521, 892, 606; D13/151

(56) References Cited

U.S. PATENT DOCUMENTS

| | | | | |
|---|---|---|---|---|
| 3,350,677 A | * | 10/1967 | Daum | 439/587 |
| 3,426,319 A | * | 2/1969 | Dawns et al. | 439/798 |
| 3,594,703 A | | 7/1971 | Holtzapple | |
| 3,629,806 A | * | 12/1971 | Wiechmann | 439/521 |
| 4,339,167 A | * | 7/1982 | Liedholm | 439/797 |
| 5,102,347 A | * | 4/1992 | Cote et al. | 439/412 |
| 5,533,912 A | | 7/1996 | Fillinger et al. | |
| 5,848,913 A | * | 12/1998 | Ashcraft | 439/521 |
| 6,210,239 B1 | * | 4/2001 | Harting et al. | 439/814 |
| 6,361,381 B1 | * | 3/2002 | Koebbe | 439/810 |

* cited by examiner

*Primary Examiner*—Tho D. Ta

(57) ABSTRACT

An electrical connector having a parallelepiped-shaped block made of electrically conductive material. The block has conductor channels extending into the body from a first surface and set-screw channels extending into the block from a second surface, there being at least one set-screw channel associated with each conductor channel. Each set-screw channel intersects its associated conductor channel. Each conductor channel has a conductor receiving section and an adapter receiving section, the adapter receiving section located between the conductor receiving section and the associated set-screw channel. The connector has an elongated adapter for each conductor channel, the adapter generally sized and shaped to fit in the adapter receiving section in the conductor channel. A set-screw is threadable into each set-screw channel to contact the adapter in each conductor channel associated with each set-screw channel, and to press the adapter tightly against a conductor inserted in the conductor receiving section of the conductor channel. The connector preferably has the block covered in a water-proof casing. The casing includes a tubular conductor flange providing entry to each conductor channel and a tubular set-screw flange providing entry to each set-screw channel. There is a sealing member associated with each conductor flange to pass a conductor there through while sealing the flange. The set-screw in each set-screw channel seals each set-screw flange associated with the channel.

2 Claims, 6 Drawing Sheets

SUBMERSIBLE ELECTRICAL SET-SCREW CONNECTOR

BACKGROUND OF THE INVENTION

1. Field of the Invention

The present invention relates to the general field of electrical connectors and is particularly concerned with a submersible, set-screw type, electrical connector.

2. Description of the Related Art

Electrical distribution systems are used extensively in most industrialized countries. These distribution systems typically include power cables, transformers and connectors for linking the components together. Some distribution systems are designed with the intent of having cables suspended from poles anchored into the ground so that the cables are located substantially above the ground surface. In such instances, the transformers and connectors are also mounted on the poles above the ground surface. Other, often more recent electrical distribution systems are designed so that the cables, transformers and connectors are located under the ground surface or in electrical pedestals. In such instances, the connections are usually made below grade in an access hole, or aperture, or in a vault, all being characterized by relatively confined space.

Many power cables have been and are being manufactured with segmented or non-segmented center conductors formed from aluminum wire strands rather than copper wire strands due to the availability of the aluminum wire and its usually lower cost. The use of aluminum wire strands, however, has its disadvantages or drawbacks.

One major drawback of aluminum wire strands is the rather rapid formation of aluminum oxide coatings on the outer surfaces of the aluminum wire strands and of associated aluminum connecting devices. Such coatings retard the flow of electrical current across the junction formed by the aluminum wire strand and a connecting device.

Additionally, aluminum wire strands experience relatively rapid metal fatigue when subjected to temperature and contraction cycles caused by changes in the ambient temperature and the operational temperature of the electrical system.

Many different types of connectors are used in the prior art to electrically couple or connect the center conductor of a low voltage distribution network to an external electrical connector. A particularly popular type of electrical connector is the so called set-screw electrical connector. These connectors typically include bodies of aluminum or copper/aluminum alloy typically having a generally parallelepiped-shaped configuration. The connector bodies are conventionally made out of an extrusion or by another suitable manufacturing process.

The parallelepiped-shaped configuration or other suitable configuration defines a first surface divided with conductor receiving blind holes or channels. A second surface typically oriented in a generally perpendicular relationship relative to the first is provided with corresponding and intersecting blind tapped holes or channels. These latter channels are configured, sized and positioned for receiving so called set-screws usually having hexagonal heads.

In use, the conductors are inserted into a blind conductor receiving hole when the set-screw is backed off. The set-screw is then tightened down on the conductor to clamp it to the body and to make the connection. Typically, the number of connections may be in the order of one to eight or even more. Such connectors are commonly used with secondary pad mount transformers, utility pedestals or the like. Examples of such structures include underground extruded or cast connectors, splices, and overhead connectors such as metering and grounding lugs.

When the connectors are used in underground distribution systems, the connections are typically made in a wet environment. It is also possible that the connection could be submerged at some point over its service life due to environmental factors such as rain, floods or even normal seasonal fluctuations of ground water. cables by the set-screws, and required for maintaining the cables within the conductor channels formed in the connectors, is such that it typically tends to spread the individual cable wires apart further reducing the effective contact area.

The poor contact problem is further compounded by the fact that the connectors are often subjected to temperature cycling which leads to cold flow, hence reducing electrical efficiency and reduced contact surfaces.

Another drawback associated with conventional set-screw type connectors, especially of the submersible type, is that although some are provided with encasing coatings, their design is such that some metallic part is often in contact with the external environment during installation and/or uninstallation procedures. Consequently, operators performing the connection or service must resort to using cumbersome, unergonomical and time consuming safety equipment.

Still further disadvantages associated with prior art set-screw type connectors relates to their relatively unergonomical design requiring manual dexterity on behalf of the operator who needs to perform size movements in a generally confined space in a difficult environment.

Upper insertion of the conductor cable in the corresponding cable receiving channel and manipulation of the protective caps mounted over the screw heads are but a few examples of numerous difficult tasks that must be performed with care due to the inherent unergonomical design of the prior art set-screw type connectors.

Accordingly, there exists a need for an improved electrical set screw type connector.

SUMMARY OF THE INVENTION

It is therefore the purpose of the present invention to provide an improved electrical set-screw type connector that will circumvent at least some of the drawbacks associated with prior art connectors. More particularly it is the purpose of the present invention to provide an improved electrical set-screw type connector that provides better contact between the conductors and the block thereby making it more efficient. It is another object of the present invention to provide an improved connector that is waterproof and that has no exposed metal parts making it safer and more reliable in use. It is another purpose of the present invention to provide an improved connector that is easier to use when making or changing connections.

In accordance with the present invention there is provided an electrical connector with an elongated, metallic, adapter located between the exposed conductor in each conductor channel and the associated set-screw in the connector block. When the set screw is tightened, it pushes the adapter against the conductor spreading the pressure exerted by the set-screw over the length of the exposed conductor and pushing it more evenly against the block over its length so as to provide better contact and thus improve efficiency. In addition, the use of the adapter helps maintain cable integrity and minimizes spreading apart of the strands of the conductor. Preferably, a belleville washer can be inserted between each set-screw and its associated adapter, the washer helping to maintain a constant pressure on the conductor by minimizing the effect of temperature related expansion/contraction cycles. The invention is also directed toward a connector block constructed to receive an adapter in each conductor channel.

In a preferred embodiment of the invention, the connector is encased in insulting material such as rubber. The rubber casing provides inlets to the conductor channels for the channels to receive the conductors and provides inlets to the set-screw channels for the channels to receive the set-screws. Both inlets are designed to be sealed against water. The inlets to the channels for the conductors are provided with closure caps having an elastic end wall with an expandable opening therein through which the conductor is passed. The elastic opening makes it easier to connect the conductors to the block and also makes it simpler to use different sized conductors in the same block. The inlets to the channels for the set-screws are dimensioned to snugly receive the set-screws preventing the entry of water. The set-screws are preferably made of non-conducting material such as plastic. No metal parts are thus exposed when the connector is encased.

Advantages of the present invention include the proposed set-screw connector allowing improved connective efficiency of a conventional electrical power cable. The proposed set-screw connector is designed to improve conductor contact so as to reduce the resistivity of the connection and, hence, reduce the heat generated thereby improving the conductivity and over all efficiency.

Furthermore, the proposed set-screw type connector is designed for receiving and retaining the center conductors of various sizes of power cables without requiring expensive and/or cumbersome modifications. The proposed set-screw type connector is designed so as to facilitate connection of the conductor cables without requiring special tooling or manual dexterity through a set of ergonomical, easy and efficient steps. Also the design facilitates insertion of the conductor cables and eases the application of the set-screws, at least in part by eliminating the need for screw caps.

Also, the proposed connector design allows for improved characteristics over an extended period of time. It also allows for improved insulation against water contact and provides a structure exempt of exposed metallic surfaces which in turn, reduces the need for expensive and cumbersome protection equipment.

Still further, the proposed set-screw type connector is designed with a reduced number of components compared to most prior art connectors and is also designed as be relative compact, again facilitating use thereof in relatively confined areas. Still further, the proposed connector is designed so as to be manufacturable using conventional forms of manufacturing so as to provide a connector that will be economically feasible, long lasting and relatively trouble free in operation.

The invention is particularly directed toward a block made of electrically conductive material, the block forming part of a set-screw type electrical connector. The block has a first surface with at least one conductor channel extending into the body from the first surface and a second surface with at least one set-screw channel extending into the block from the second surface. There is at least one set-screw channel associated with each conductor channel. Each set-screw channel intersects its associated conductor channel. Each conductor channel has a conductor receiving section and an adapter receiving section, both sections extending substantially the length of the channel. The adapter receiving section is located between the conductor receiving section and the associated set-screw channel.

The invention is also particularly directed toward a set-screw type electrical connector having a block made of electrically conductive material. The block has a first surface with at least one conductor channel extending into the body from the first surface and a second surface with at least one set-screw channel extending into the block from the second surface, there being at least one set-screw channel associated with each conductor channel. Each set-screw channel intersects its associated conductor channel. Each conductor channel has a conductor receiving section and an adapter receiving section, both sections extending substantially the length of the channel. The adapter receiving section is located between the conductor receiving section and the associated set-screw channel. An elongate adapter is provided for each conductor channel, the adapter sized and shaped to fit in the adapter receiving section in the conductor channel. A set-screw is threadable into each set-screw channel to contact the adapter in each conductor channel associated with each set-screw channel, and to press the adapter tightly against a conductor inserted in the conductor receiving section of the conductor channel.

DESCRIPTION OF THE PREFERRED EMBODIMENTS

Figure 1:
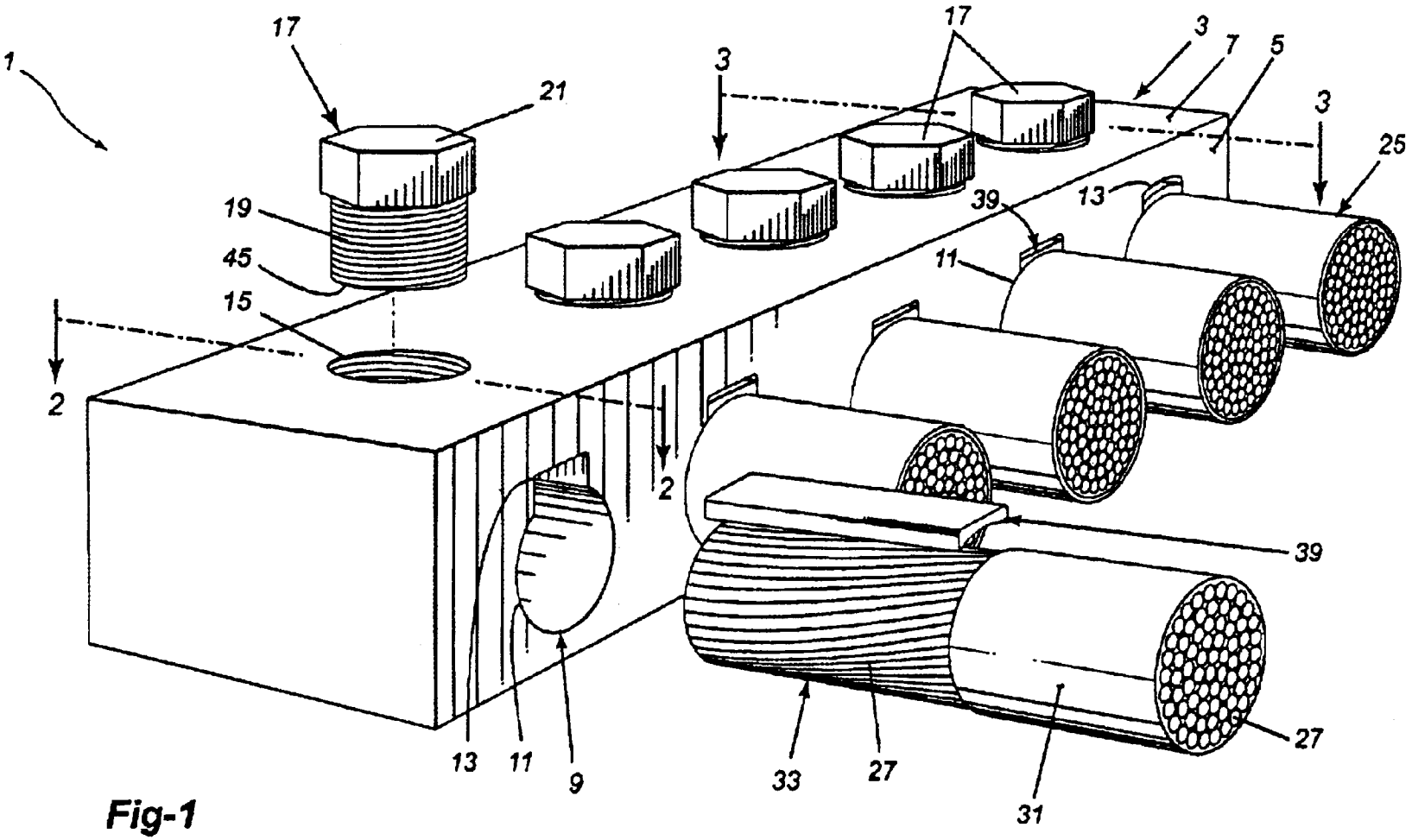
FIG. 1 is a perspective view of some of the elements employed in the electrical set-screw connector.
Figure 2:
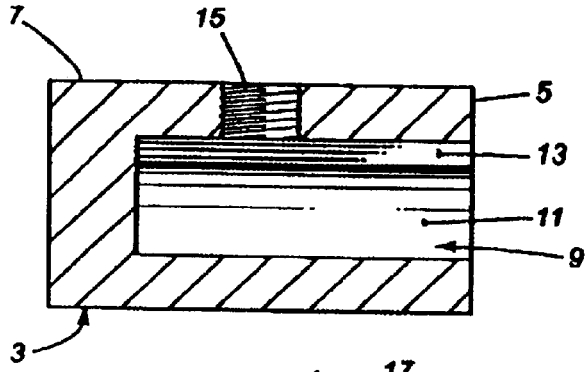
FIG. 2 is a cross-sectional view of the block used in the connector taken along line 2—2 in FIG. 1.

The set-screw connector 1 of the present invention, in one embodiment as shown in FIGS. 1 to 4, has a metallic block 3. The block 3 preferably has a generally parallelepiped shape with top and bottom quadratic surfaces, front and back quadratic surfaces and quadratic end surfaces. One of the top, bottom, front and back surfaces forms a first block surface 5. One of the other of the top, bottom, front and back surfaces, attached to the first block surface, forms a second block surface 7. The second block surface 7 is perpendicular to the first block surface 5. While a parallelepiped shape is preferred, the block can have other shapes.

The block 3 has at least one, and preferably a set, of blind conductor channels 9 extending into the block from the first surface 5. The conductor channels 9 extend transverse to the first surface 5 and are parallel to the second surface 7, and to each other. Each conductor channel 9, when seen in transverse cross-section, has a part circular section 11 topped by a somewhat rectangular section 13. The part circular section 11 serves as a conductor receiving section, and the rectangular section 13 serves as an adapter receiving section. The conductor channel, when seen in cross-section, as in FIG. 4, has an inverted key-hole shape.

The block 3 also has at least one set-screw channel 15 associated with each conductor channel 9. Each set-screw channel 15 extends into the block 3 from the second surface 7 to intersect the conductor channel 9 at about its midpoint in length. The set-screw channel 15 intersects the conductor channel 9 in its rectangular section 13. Each set-screw channel 15 is threaded and receives a set-screw 17 that threads into the set-screw channel 15. The set-screw 17 is preferably made from suitable plastic material, and has a threaded body portion 19 topped by a head portion 21. The head portion 21 is preferably hexagon-shaped as shown. Other head shapes can be employed.

Figure 3:
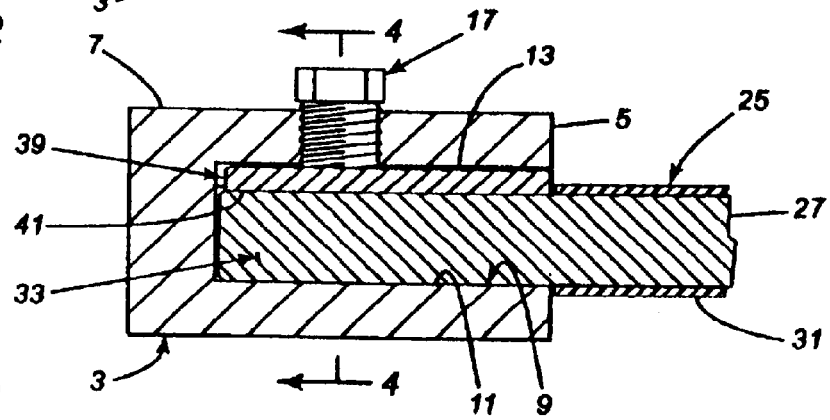
FIG. 3 in a cross-sectional view taken along line 3—3 in FIG. 1.
Figure 4:
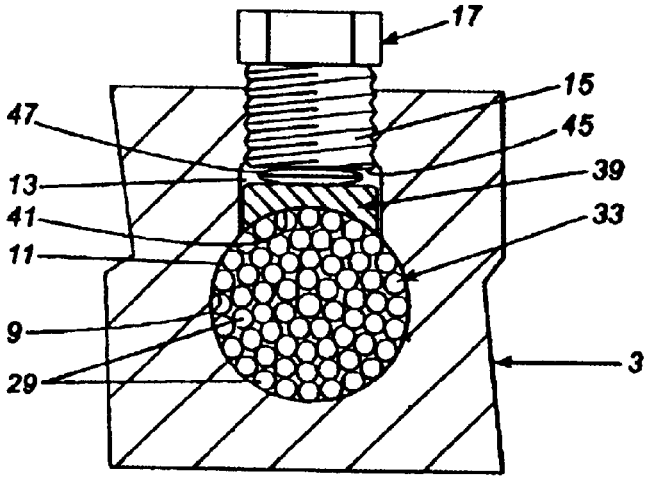
FIG. 4 is a cross-sectional view taken along line 4—4 in FIG. 3.

A conductor 25 is fully insertable into each conductor channel 9 with the set-screw 17 associated with that channel backed off. The conductor 25 usually comprises a core 27, consisting of a plurality of twisted, metallic, wires or stands 29, the core covered by a sheath 31 of insulation material. The leading end 33 of the conductor 25 within the channel 9 has the insulation sheath 31 removed leaving only the core 27. The leading end 33 of the conductor is snugly located in the conductor receiving section 11 of the conductor channel 9, when inserted into the channel and passes past the intersecting set-screw channel 15 as shown in FIG. 3.

In accordance with the present invention, an adapter 39 is provided for each conductor leading end 33. The adapter 39 is metallic, elongated, and has a cross-sectional shape generally the same as the rectangular section 13 of the conductor channel 9. The adapter 39 is nearly as long as the conductor channel 9 and preferably has a bottom contact surface 41 curved to match the curvature of the core 27 of the conductor 25. The adapter 39 is placed on the conductor leading end 33 when the conductor is to be inserted into the conductor channel 9, the bottom surface 41 of the adapter abutting a longitudinal section the leading end 33 of the conductor.

When the leading end 33 of the conductor 25, along with the adapter 39, has been fully inserted into the conductor channel 9, the adapter 39 is located within the adapter receiving section 13 of the channel 9 and lies between the leading end 33 of the conductor and the set-screw 17. The set-screw 17 is now tightened to have its tip 45 abut the adapter 39 and to firmly press the adapter 39, over its length, against the leading end 33 of the conductor 25 and thus firmly press the leading end 33 against the wall of the channel 9 to provide good electrical contact between the conductor and the block 3. The adapter 39 distributes the pressure exerted by the set-screw 17 over the length of the leading end 33 of the conductor 25 to provide better contact while maintaining the integrity of the conductor.

To improve the electrical contact between the leading end 33 of the conductor 19 and the block 3, when the set-screw 17 is tightened, the interior surface of the conductor channels 9 can be treated, such as by sand-blasting, to roughen them. The contact surface 41 of the adapters 29 can be similarly treated. To maintain good electrical contact, at least one spring washer 47, such as a belleville washer, can be inserted between the tip 45 of the set-screw 17 and the adapter 39.

Figure 5:
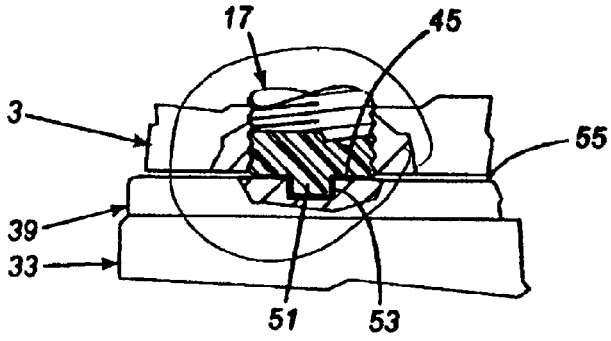
FIG. 5 is a detail view, partly in section, showing a connection between the set-screw and the adapter.
Figure 6:
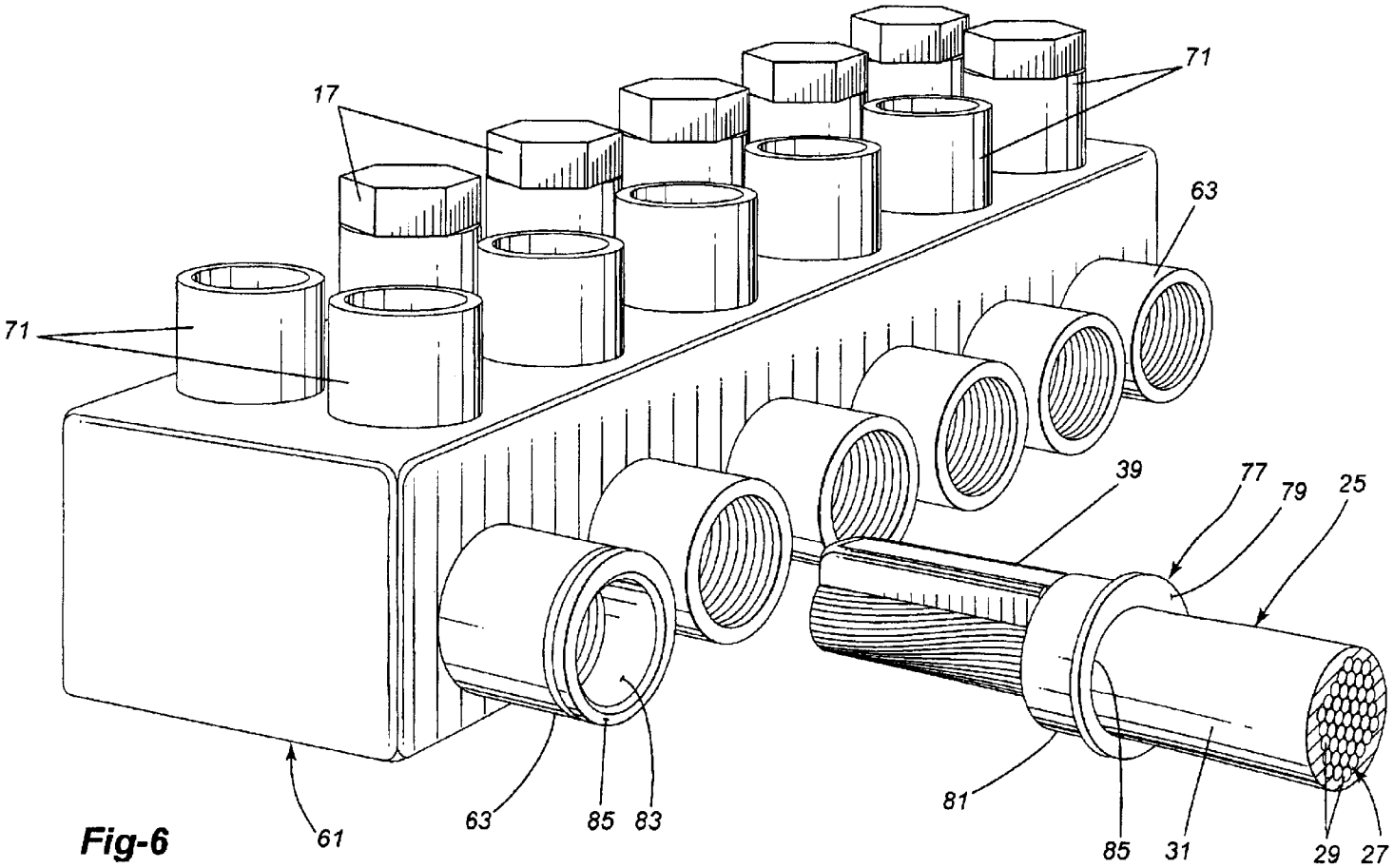
FIG. 6 is a perspective view of a preferred embodiment of the connector.
Figure 7:
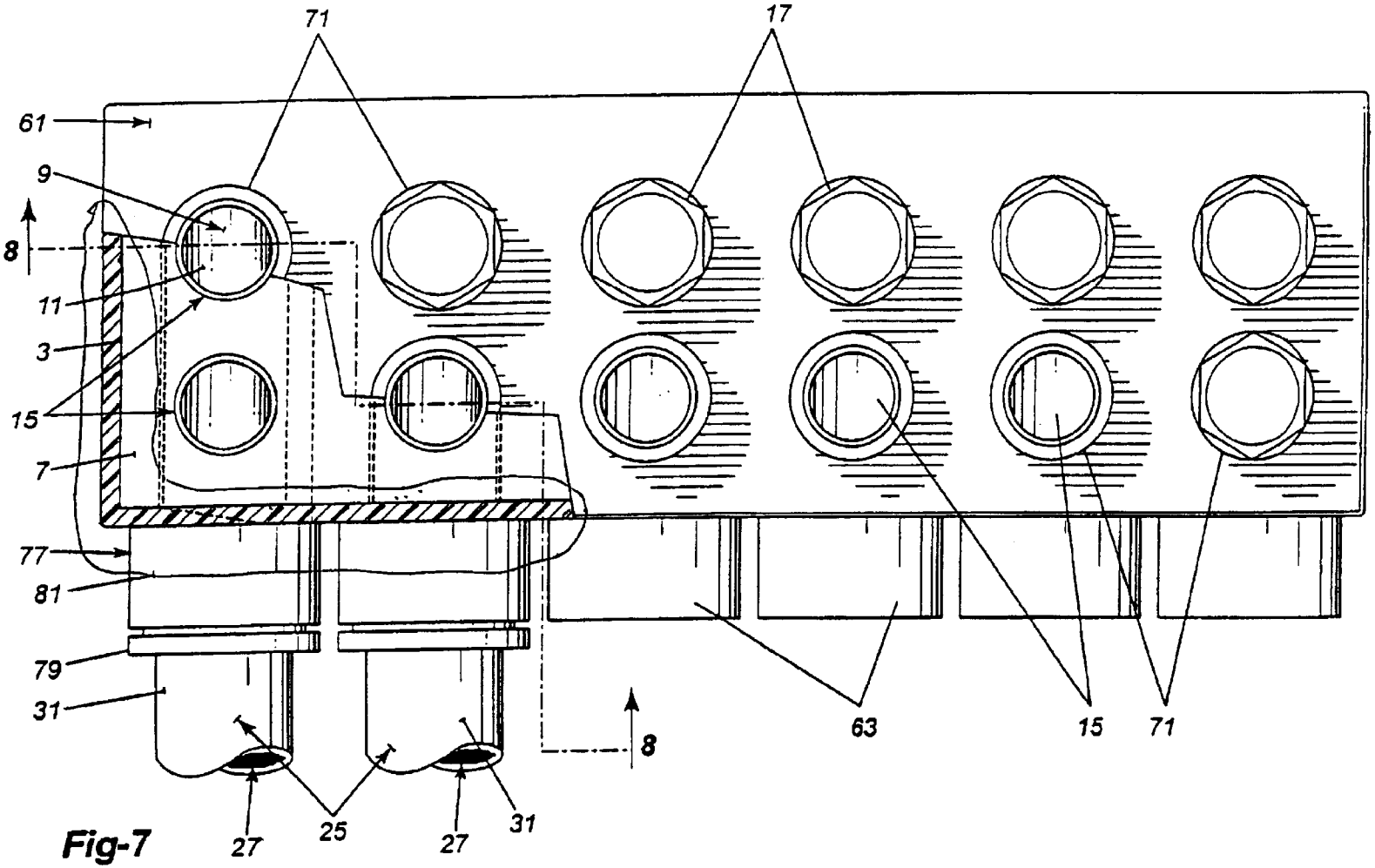
FIG. 7 is a top view, in partial section, of the connector shown in FIG. 6.

If desired, a connection can be formed between the adapter 39 and the set-screw 17 to help maintain the contact between the set-screw 17, the adapter 39 and the leading end 33 of the conductor 25. The connection, as shown in FIG. 5, can be formed providing a pin 51 on the tip 45 of the set-screw 17, the pin 51 fitting in a hole 53 provided on the top surface 55 of the adapter 39. The connection retains the adapter 39 in place. Other types of adapter retaining means can be employed.

While one set-screw channel 15 has been shown associated with each conductor channel 9, two set-screw channels could be provided for each conductor channel. The use of two set-screw channels would provides more uniform pressure distribution over the length of the leading end of the conductor and thus better contact.

In a preferred embodiment of the invention, the set-screw electrical connector 1, shown in FIG. 1, can be provided with a waterproof casing. More particularly, as shown in FIGS. 6 to 9, the body 3 is encased with a plastic waterproof casing 61. In the embodiment shown, there are two set-screw channels 15 for each conductor channel 9, both set-screw channels 15 intersecting with its respective conductor channel 9.

The casing 61 includes a tubular conductor flange 63 surrounding the mouth 65 of each conductor channel 9, the flange 63 open at the bottom to provide access to the conductor channel. The conductor flanges 63 extend outwardly away from the first surface 5. Each flange 63 is aligned with its respective conductor channel 9 to provide access thereto, and is large enough to pass both the conductor 25 and the adapter 39.

Figure 9:
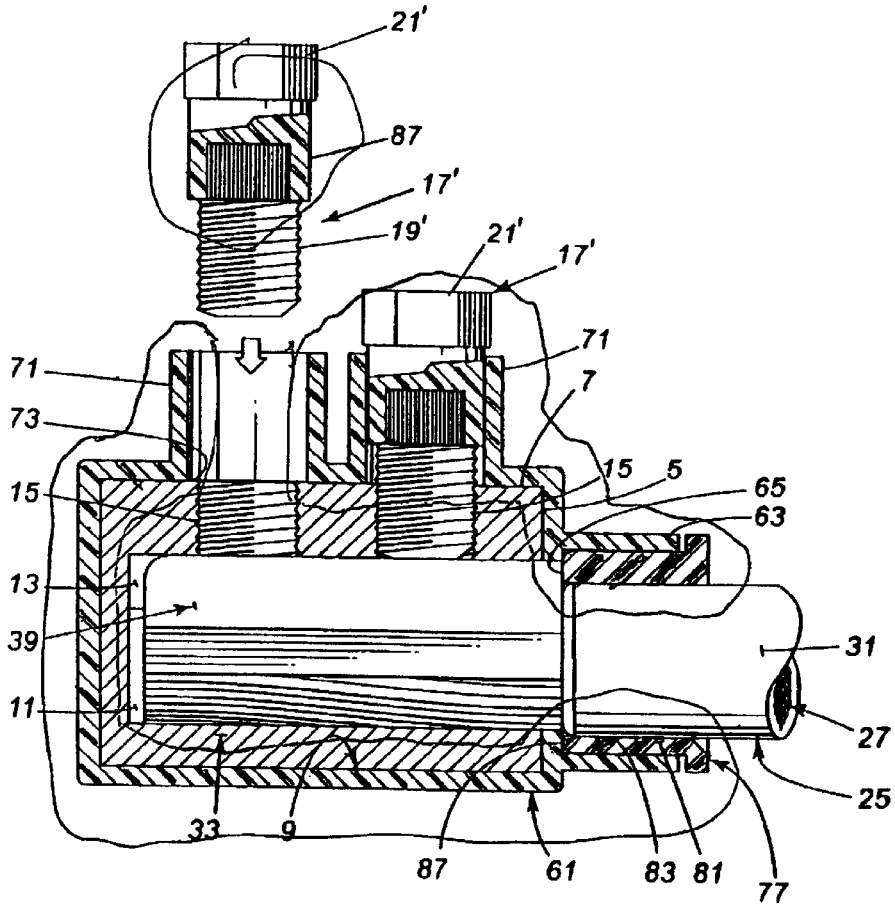
FIG. 9 is a cross-section view along line 9—9 in FIG. 8.
Figure 10:
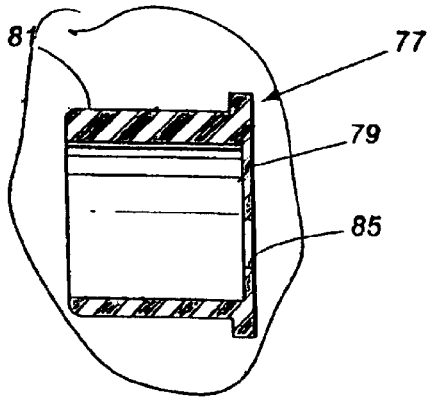
FIG. 10 is cross section view of the sealing member.

The casing 61 also includes a tubular set-screw flange 71 surrounding the mouth 73 of each set-screw channel 15, the flange open at the bottom to provide access to the set-screw channel. The set-screw flanges 71 extend outwardly away from the second surface 7. Each flange 71 is aligned with its respective set-screw channel 9 to provide access thereto, and is large enough to pass a set-screw 17. When using the casing 61, a sealing member 77 is provided for each conductor channel 9. The sealing member 77, as shown in FIG. 10 is cup-shaped with an end wall 79 and a tubular wall 81 extending from the end wall 79. The end wall 79 is slightly larger in diameter than the tubular wall 81. The sealing member 77 is sized to fit snugly between the sheath 31 of the conductor 25 and the inner surface 83 of the conductor flange 63 associated with the conductor channel to seal the mouth 65 to the conductor channel 9 against water as shown in FIG. 9. At least the end wall 79 of the sealing member is elastic, and a small opening 85 is provided in the end wall 79 which opening can be expanded to pass the conductor 25 through the end wall while keeping water out. When the sealing member 77 is mounted in the conductor flange 63, its end wall 79 abuts the end wall 87 of the flange 63.

When using the casing 61, each set-screw 17' has an unthreaded body portion 87 between the head 21' of the screw and the threaded body portion 19'. This unthreaded body portion 87 is dimensioned to fit snugly within the set-screw flange 71, as shown by one of the set-screws in FIG. 9, to keep water out.

It will be seen that using a casing 61 provided with integral tubular flanges 63, 71 for receiving the conductors and set-screws, and sealing these flanges with sealing members 77 and the set-screws, water-proofs the connector making it feasible for underwater use. The casing is made from suitable flexible thermoplastic material while the sealing members are made from suitable elastomeric materials. Alternatively, the tubular portion of the sealing member can be made suitable thermoplastic material while the end wall is made from elastomeric material.

Figure 8:
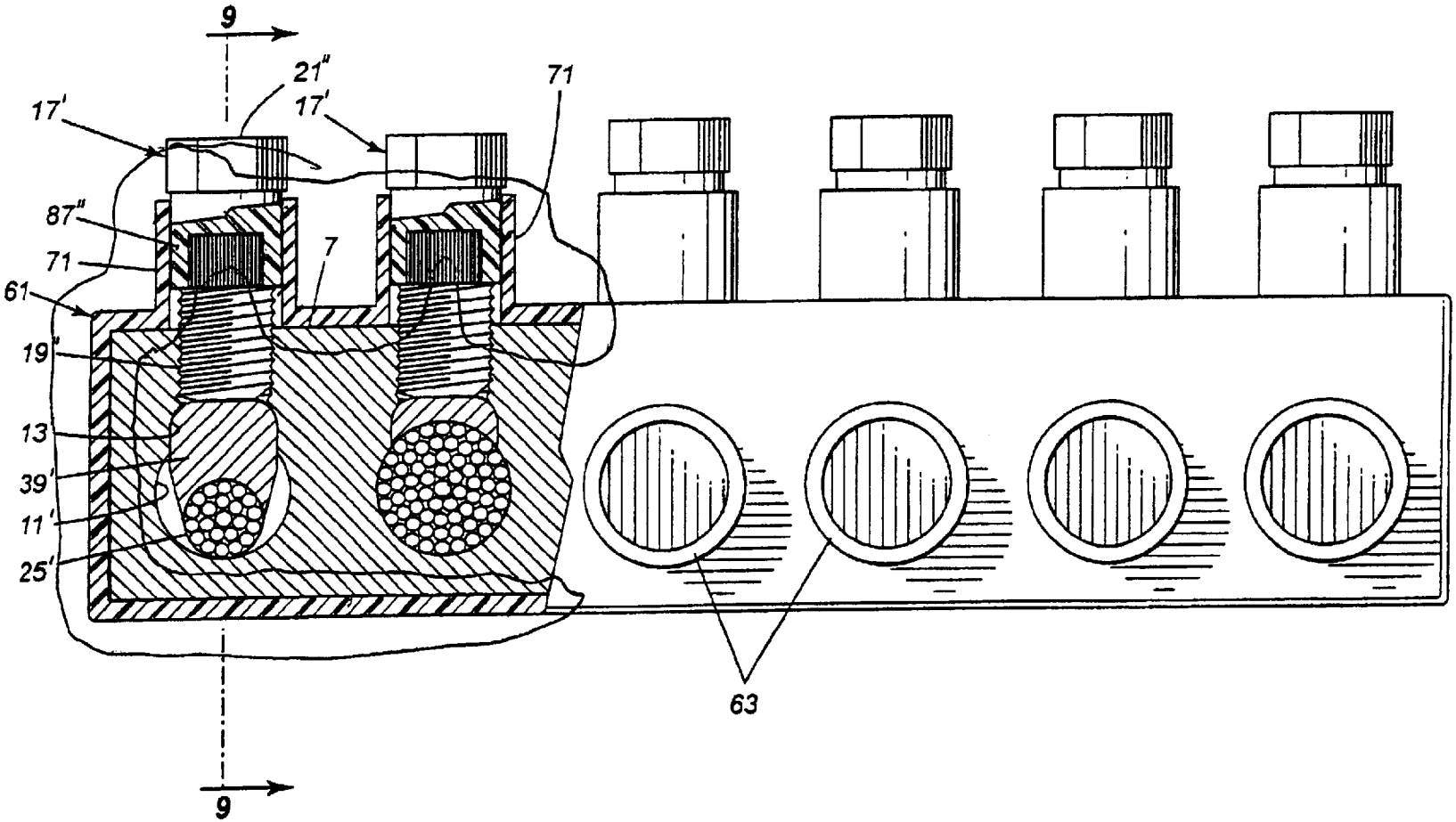
FIG. 8 is a front view, in partial section, of the connector shown in FIG. 6.

The conductor channel 9 has been described as being sized to snugly receive the leading end of the conductor together with the adapter. Connectors can be provided with conductor channels sized for different sizes of conductors. In this case, the same adapter can be used with different sizes of conductors or different sizes of adapters can be used with different sizes of conductors. Alternatively, connectors can be provide with just one size of conductor channel 9 as shown in FIG. 8, and different size adapters can be used to accommodate different size conductors in the channel. As shown in FIG. 8, for example, a large adapter 39', extending from the adapter receiving section 13' into the conductor receiving section 11' of the channel could be used with a small conductor 25'. In this case, the sealing member would have to be modified accordingly to fit the smaller conductor used with the large conductor flange.

While the set screw alone has been used to seal the set-screw flange, other sealing means could be employed with the set-screw if desired. The set-screw has been described as being made in one piece from plastic material. It could also be made in two parts with one part metal and the other part plastic as shown in FIG. 8. The threaded portion 19' can be made of metal while the head 21" and intermediate portion 87' is made form plastic material. Suitable connecting means join the two parts together.

What is claimed is:

1. An electrical connector having:

a block made of electrically conductive material; the block having a first surface with at least one conductor channel extending into the block from the first surface and having a second surface with at least one set screw channel ext nding into the block from the second surface, there being at least one set screw channel associated with each conductor channel; each set screw channel intersecting its associated conductor channel; ach conductor channel having a conductor receiving section and an adapter receiving section, the adapter receiving section located between the conductor receiving section and the associated set screw channel, the interior surface of the conductor channel is treated to provide better electrical contact with the conductor; the block is covered by a waterproof casing, the casing having an integral tubular set-screw flange associated with each set-screw channel, each set-screw flange extending outwardly away from the second surface and providing entry to its associated set-screw channel;

an elongated adapter for each conductor channel, the adapter generally sized and shaped to fit in the adapter receiving section in the conductor channel;

and a set-screw threadable into each set-screw channel to contact the adapter in each conductor channel associated with each set-screw channel, and to press the adapter tightly against a conductor inserted in the conductor receiving section of the conductor channel, the set screw having a body portion sized to fit snugly within the set-screw flange to seal the flange to the entry of water.

2. An electrical connector having:

a block made of electrically conductive material; the block having a first surface with at least one conductor channel extending into the block from the first surface and having a second surface with at least one set screw channel extending into the block from the second surface, there being at least one set screw channel associated with each conductor channel; each set screw channel intersecting its associated conductor channel; each conductor channel having a conductor receiving section and an adapter receiving section, the adapter receiving section located between the conductor receiving section and the associated set screw channel, an elongated adapter for each conductor channel, the adapter generally sized and shaped to fit in the adapter receiving section in the conductor channel;

and a set-screw threadable into each set-screw channel to contact the adapter in each conductor channel associated with each set-screw channel and to press the adapter tightly against a conductor inserted in the conductor receiving section of the conductor channel, and a connection between each set-screw and the adapter to retain the adapter in position.

* * * * *